United States Patent [19]

Hadary

[11] 4,033,007

[45] July 5, 1977

[54] TOOTHBRUSH

[76] Inventor: Joseph Hadary, 5405 Linden Court, Bethesda, Md. 20014

[22] Filed: Apr. 7, 1976

[21] Appl. No.: 674,438

Related U.S. Application Data

[63] Continuation-in-part of Ser. No. 564,074, April 1, 1975.

[52] U.S. Cl. ..... 15/172; 15/143 R; 15/176; 132/90

[51] Int. Cl.[2] ..... A46B 9/10

[58] Field of Search ..... 15/172, 176, 184, 185, 15/143 R, 144 B; 145/62; 30/125; 401/195, 184; 132/88.7, 92, 90

[56] References Cited

UNITED STATES PATENTS

| | | | |
|---|---|---|---|
| 1,848,543 | 3/1932 | Priest | 15/176 |
| 2,091,716 | 8/1937 | Petta | 15/172 |
| 2,679,657 | 6/1954 | Krueger | 15/172 |
| 2,749,567 | 6/1956 | Krveger | 15/172 |
| 3,886,618 | 6/1975 | Paoletti | 15/172 |

FOREIGN PATENTS OR APPLICATIONS

| | | | |
|---|---|---|---|
| 649,074 | 8/1928 | France | 15/172 |
| 640,702 | 4/1928 | France | 132/92 R |
| 806,597 | 12/1958 | United Kingdom | 15/172 |

*Primary Examiner*—Peter Feldman
*Attorney, Agent, or Firm*—Shoemaker and Mattare, Ltd.

[57] ABSTRACT

A toothbrush having a bristle supporting head pivotaly mounted to a handle for pivotal movement of the head and bristles about a pivot axis substantially perpendicular to the axis of the handle to a plurality of positions to gain easy access to tooth surfaces at opposite sides of the mouth, the bristles extending in a direction mutually perpendicular to the axis of the handle and pivot axis, and the handle having an enlarged hollow end for storage therein of a bristle supporting head or the like and for supporting the toothbrush in an upright, free standing position.

6 Claims, 8 Drawing Figures

TOOTHBRUSH

BACKGROUND OF THE INVENTION

This application is a continuation-in-part application of Ser. No. 564,074, filed Apr. 1, 1975, entitled "Toothbrush".

This invention relates to dental equipment for promoting oral hygiene and, in particular, relates to a unique and improved toothbrush for effecting more thorough cleansing of teeth and gum areas near the base of the teeth. With prior art toothbrushes it is very difficult to effectively clean the gingival margins and sulcus areas, particularly is difficult to reach portions of the mouth, because of the fixed relationship of the bristles to the handle, and also due to the large size of the bristles and handle. Further, the construction of prior art toothbrushes makes it necessary to tilt the handle both horizontally and vertically in order to reach certain areas of the teeth.

The importance of cleaning not only the tooth surfaces, but also of cleaning the gingival crevice and of massaging the gums is clearly evident when it is recognized that diseases of the gums, such as gingivitis, for example, afflict approximately 65% of the nation's school children, and in adults, at the age of 40 for example, nearly 100% have some form of tooth or gum disease. If the teeth were properly cleaned, the bacteria which cause tooth and gum diseases could be significantly reduced, if not eliminated, and the incidence of disease reduced accordingly.

One of the most common and widely used dental instruments for cleaning the teeth and gums is the toothbrush, but unfortunately, for the reasons suggested above, the toothbrush is not frequently used correctly, and according to one report ("Toothbrushing — the Hoax of American Dentistry", Robert F. Barkley, *Arizona Dental Journal*, 1967), the toothbrush and its use is probably responsible for only a 10% reduction in tooth and gum diseases.

In this connection, there are many widely recognized and proven methods of using a toothbrush, and such methods include the vertical, rolling, Fones, Stillman and Charters methods. Whichever method used, it is desirable to thoroughly clean the interproximal areas of the teeth, as well as the buccal and lingual surfaces, and the sulcus areas at the base of the teeth. Also the occlusal surfaces of the teeth should be thoroughly cleaned. However, due to the natural arc of the teeth, and the fact that the teeth have both concave and convex surfaces and the teeth are of different sizes, on both upper and lower jaws, and teeth are frequently malposed, all tooth surfaces are usually not effectively cleaned. Also, the buccal surfaces of the posterior teeth are particularly difficult to clean because of the inward pressure of the cheek aganist these teeth.

Many attempts have been made in the prior art to devise a toothbrush capable of performing satisfactorily all of the above functions. However, most efforts in this regard have been directed toward different bristle configurations, whereby the bristles are constructed such that they more readily enter the interproximal areas or the gingival margins at the base of the teeth. However, even with such prior are constructions, it is very difficult to reach the lingual surfaces of the lower anterior teeth, and the buccal surfaces of the posterior teeth, as well as the gingival crevice of the posterior teeth. For example, when attempting to brush the lingual surfaces of the lower anterior teeth, it is necessary with prior art toothbrush constructions to elevate the handle of the toothbrush in order that access of the bristles to the lingual surfaces of the anterior teeth can be gained. This, of course, is awkward for anyone to do, and is particularly difficult for persons suffering from arthritis or other ailments which renders it difficult for them to elevate their arms above certain positions, and it is also difficult for children to manipulate the handle in a proper manner to gain proper access to the various surfaces of the teeth. Consequently, such persons, including small children, frequently do not brush the difficult to reach surfaces of the teeth, and the incidence is thereby increased.

The toothbrush according to the present invention is relatively small in comparison with conventional prior art toothbrushes, and may be easily carried in the pocket or the like for use away from home. Further, the base of the handle of the present toothbrush enables the toothbrush to be free standing, thus avoiding the hygienic problems encountered due to laying a conventional toothbrush on an unclean surface, or supporting it from a holder or the like.

Additionally, the bristle head of the toothbrush of the invention is small in size, thus making it easier to use to reach relatively inaccessible areas of the mouth. Further, with the toothbrush of the invention, the small, replaceable bristle head can easily be replaced, and it is not necessary to replace the whole toothbrush, as with prior are toothbrushes.

OBJECTS OF THE INVENTION

Accordingly, it is an object of this invention to provide a toothbrush having a unique construction which provides for easy access of the bristles to all of the surface areas of the teeth in a person's mouth.

Another object of the invention is to provide a toothbrush having a pivotal head carried by the handle thereof, such that the head may be pivoted to a plurality of positions, and in said positions, access to the lingual surfaces of the teeth on opposite sides, respectively, of the mouth is greatly enhanced, and wherein the handle is small and is configured whereby is may be readily grasped and manipulated with the fingers.

A further object of the invention is to provide a toothbrush having a pivotal head thereon which is offset from the handle axis, whereby the handle and bristles in effect straddle the teeth, and access to all of the lingual and buccal surfaces of the teeth can be gained without requiring excessive elevation of the toothbrush handle and the like, thus rendering it mush easier for all persons, and particularly infirm persons or small children, to gain access to those areas of the teeth.

A still further object of the invention is to provide a toothbrush having a removable head and bristles thereon, whereby heads having different bristle configurations can be quickly and easily attached to the handle for providing the best bristle configuration for particular cleaning operations to be performed on the teeth and gums, such as, for example, small bristle heads for reeaching confined areas in the mouth.

Yet another object of the invention is to provide a toothbrush having a pivotally mounted head and bristle arrangement, wherein the handle of the toothbrush has a hollow storage compartment therein and is enlarged such as to be self-supporting in an upright, free standing position.

DETAILED DESCRIPTION OF THE PREFERRED EMBODIMENTS

Figure 1:
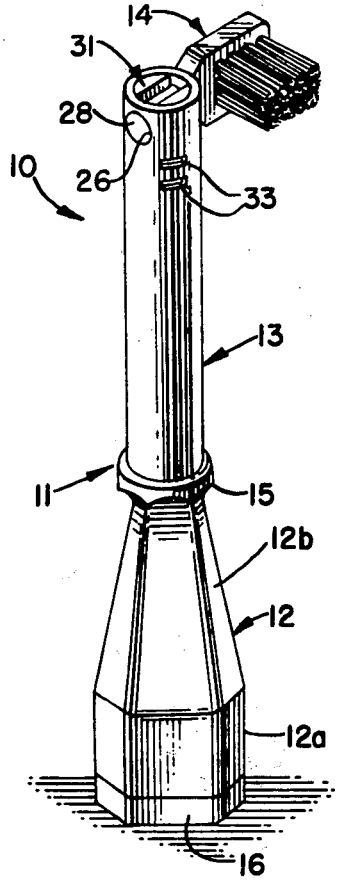
FIG. 1 is a top perspective view of the preferred form of toothbrush according to the invention, and shows the toothbrush supported in an upright, free standing position.
Figure 2:
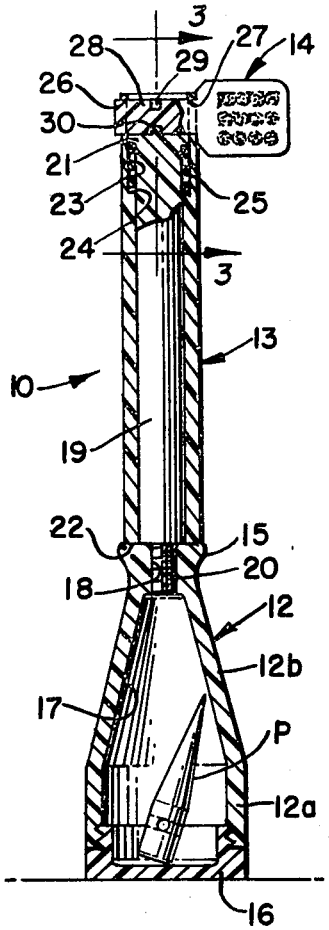
FIG. 2 is a vertical sectional view of the toothbrush in FIG. 1
Figure 3:
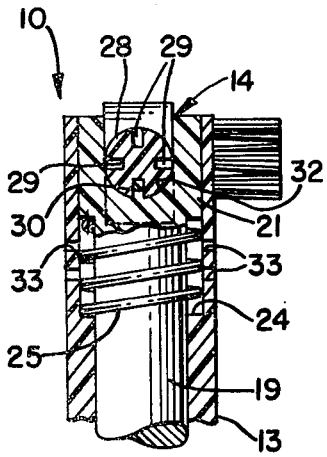
FIG. 3 is an enlarged, fragmentary, sectional view taken along line 3—3 in FIG. 2

In the drawings, wherein like reference numerals indicate like parts throughout the several views, a first form of brush in accordance with the invention is indicated generally at 10 in FIGS. 1–3, and comprises and upright, self-supporting handle 11 having an enlarged, hollow base end 12, and an elongate, tubular forward end 13 axially slidable relative to the base end 12. A bristle head configuration 14 is releasably connected to the upper or distal end of the forward end portion 13 of the handle 11.

The base portion 12 of the handle in one form of the invention is hexagonal in cross-sectional configuration, and includes a substantially constant diameter lower end portion **12*a* and a convergent upper end portion 12*b* terminating in a diametrically enlarged thumb-engaging portion 15. A removable end cap 16 is suitably removably secured in the lower open end of base portion 12, defining an enclosed, hollow storage chamber or compartment 17 in the base portion in which various items may be stored, as, for example, a bristle head 14 or pick implement or the like P. The upper end of the base portion 12 is internally threaded at 18. An elongate support shaft or rod 19 extends coaxially from the upper end of the base portion 12 and has a reduced diameter externally threaded lower end extension 20 threadably engaged in the threaded opening 18 in the upper end of base portion 12 for supporting the support shaft or rod 19 thereon. The upper end of the support shaft or rod has a diametrically enlarged portion or flange 21** thereon, defining a spring stop shoulder.

The slidable, upper tubular end 13 of the handle is telescopically engaged over the support shaft or rod 19 and has an open lower end 22, which normally abuts against the upwardly facing end surface of the thumb-engaging portion on the upper end of base portion 12. The upper end of the sleeve 13 has a diametrically enlarged inner bore portion 23 defining an upwardly, axially facing stop shoulder 24 is spaced, opposed, confronting relation to the spring stop shoulder defined by flange 21. A coil spring 25 is engaged between its ends on the respective stop shoulders for resiliently biasing the sleeve downwardly into engagement with the upper end of the base portion, as shown in FIG. 2.

The upper end of the sleeve 13 has a pair of diametrically opposite aligned openings or holes 26 and 27 formed therethrough adjacent the extreme upper end thereof and the bristle head 14 includes a cylindrical, elongate shaft 28 rotatably received in the openings 26 and 27.

As seen best in FIGS. 2 and 3, the shaft 28 has a plurality of short bores or recesses 29 formed therein in circumferentially spaced apart locations therearound for cooperation with a detent pin 30 on the upper end of the support shaft or rod 19 to retain the bristle head 14 in a selected one of a plurality of adjusted, rotated positions.

The support shaft or rod 19 has a bifurcated upper end structure at 31 defining a generally U-shaped recess 32 in which the shaft 28 is received, and at the bottom of which the pin 30 is formed.

The sleeve 13 additionally has a plurality of cleaning openings 33 formed through the side thereof in the vicinity of the internally enlarged upper end portion wherein the spring 25 is received, which, in conjunction with the open upper end of the handle, enables water or other cleaning liquid to be flushed through the openings and through the spring receiving chamber for cleansing the toothbrush.

The various components of the brush may be made of plastic or metal or other suitable material, as desired, and the cap 16 may be press-fitted into place or retained with a snap detent rather than the threaded engagement shown in the drawings. Additionally, the support shaft or rod 19 may be formed integrally with the base portion 12 rather than separately attached thereto, as illustrated and described, and the shaft 28 of the bristle head structure 14 may be snugly received in the openings 26 and 27 so as to enable its rotation therein, but prevent it form dropping out of the openings when the pin 30 is retracted from the openings 29.

Figure 5:
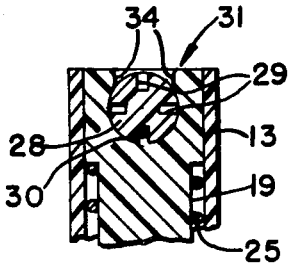
FIG. 5 is a fragmentary view in section of a portion of the end of the handle showing a modified form of attachment means for the bristle head to the handle.

In FIG. 5 a modified form of the the invention includes inwardly directed detent portions 34 on the confronting inner end surfaces of the bifurcated end 31 of support rod 19, whereby a positive forecful action is required in order to urge the sleeve 13 and bristle head 14 with shaft 28 thereof upwardly to free the pin 30 from the opening 29.

Figure 6:
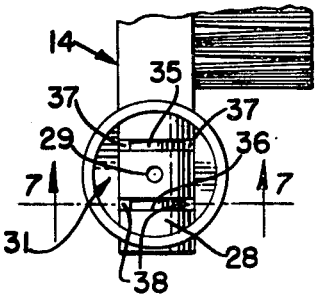
FIG. 6 is a plan view of a second modification of the invention showing a further structural arangement for attaching the bristle head to the handle.
Figure 7:
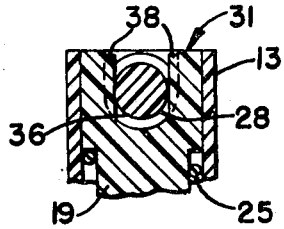
FIG. 7 is a fragmentary view in section taken along line 7—7 in FIG. 6.

A further modification of the invention is shown in FIG. 6 and 7, and this form of the invention is substantially the same as that previously described, except that the shaft 28 of the bristle head 14 has a pair of circumferential, spaced apart channels 35 and 36 formed therein, in which a plurality of parallel, spaced apart ribs 37 and 38 formed on the inner confronting surfaces of bifurcated end 31 are slidably engaged to prevent the shaft 28 of the bristle head 14 from falling or slipping out of the openings 26 and 27 when the pin 30 is disengaged. However, the ribs are disengaged from the channels upon the requisite amount of movement of the sleeve 13, to enable the bristle head to be removed.

Figure 8:
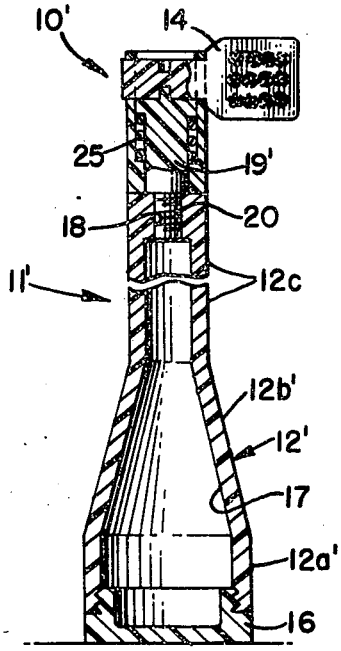
FIG. 8 is a vertical sectional view with a portion thereof broken away of a third modification of the invention.

A further modified toothbrush 10' is illustrated in FIG. 8, and in this form of the invention the handle 11' includes a base portion 12' having a lower end **12*a*' and converging intermediate portion 12*b*', with an elongate, tubular, reduced diameter upper end and portion 12*c*. A cap 16 is releasably engaged on the lower open end of base portion 12' and defines a hollow cavity or chamber 17 in the base portion, as in the previous form of the invention, and a substantially shorter support shaft or rod 19' has a lower threaded end 20 engaged in a threaded opening 18 in the upper end of base portion 12'**.

Figure 4:
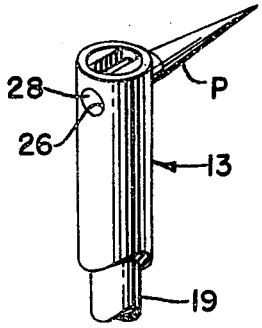
FIG. 4 is a fragmentary, perspective view of a portion of the toothbrush handle showing a pick attached thereto rather than the bristle head configuration.

In FIG. 4 the pick P is shown attached to the handle in place if the bristle head 14.

The toothbrush of the present invention may be completely disassembled for cleaning, repair or replacement of various parts, without requiring the use of any special tools or the like.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims. 9n

I Claim:

1. A toothbrush, comprising: an elongate handle means having opposite end portions, one of said end portions comprising a hollow, diametrically enlarged base capable of supporting the toothbrush in an upright position and of a size to receive and store a bristle head therein, said base extending over approximately one-third the length of the handle means; the other end of the handle means including en elongate shaft fixed at one end thereof to one end of the base and extending axially therefrom; a sleeve telescopically received over the shaft and axially slidable relative thereto, said sleeve and shaft being approximately the same length and extending over approximately the other two-thirds of the length of the handle means; a bristle head adjustably carried by the handle means at said other end thereof and including a bristle head shaft projecting therefrom, said bristle head shaft extending at approximately a right angle to the axis of the handle means and releasably adjustably engaged with the handle means to support the bristle head in adjusted positions on the handle means; and bristles on the bristle head extending in a direction mutually perpendicular to the axis of the handle means and the axis of the bristle head shaft.

2. A toothbrush, comprising: an elongate handle means having opposite end portions, one of said end portions comprising a base; an elongate support shaft fixed to the base at one end thereof and extending axially therefrom; the other of said end portions comprising a sleeve coaxially received on said shaft and axially slidable relative to the shaft and to the base; a bristle head removably and pivotally adjustably carried by the handle means at the said other end thereof; said bristle head including a shaft projecting therefrom; said sleeve having a pair of diametrically opposed openings therein in which said bristle head shaft is rotatably received; first bristle head retaining means for holding the bristle head in its adjusted positions and comprising a plurality of recesses in said bristle head shaft spaced circumferentially there-around, and a pin on said support shaft engagable in said recesses; and second bristle head retaining means to retain said bristle head in position on said handle means when said pin is disengaged from said resesses, said second bristle head retaining means comprising interengaging means on said bristle head shaft and on said support shaft at said other end of said handle means.

3. A toothbrush as in claim 2, wherein the base is hollow and defines a storage chamber for stowing a bristle head or the like therein; and a removable closure on the end of said base for gaining access to the chamber.

4. A toothbrush as in claim 1 wherein cleaning openings are formed in said handle means at its said other end portion for flow of a cleansing liquid through a portion of said handle means to clean the same.

5. A toothbrush in claim 2, wherein said second bristle head retaining means comprises a pair of spaced apart circumferential channels in said bristle head shaft; and said support shaft has a bifurcated end in which said bristle head shaft is received; said bifurcated end having a plurality of ribs thereon engaged in said channels retaining said bristle head in position on said handle means.

6. A toothbrush as in claim 1, wherein the support shaft, base, sleeve, spring and bristle head are all releasably connected together whereby the toothbrush may be readily disassembled for cleaning, repair or replacement of parts, without requiring special tools.

* * * * *